US011385597B2

(12) United States Patent
Silvant

(10) Patent No.: US 11,385,597 B2
(45) Date of Patent: Jul. 12, 2022

(54) ANNULAR ROTATING BEZEL SYSTEM COMPRISING A SPRING RING

(71) Applicant: OMEGA SA, Biel/Bienne (CH)

(72) Inventor: Olivier Silvant, Macolin (CH)

(73) Assignee: OMEGA SA, Biel/Bienne (CH)

( * ) Notice: Subject to any disclaimer, the term of this patent is extended or adjusted under 35 U.S.C. 154(b) by 565 days.

(21) Appl. No.: 16/290,997

(22) Filed: Mar. 4, 2019

(65) Prior Publication Data

US 2019/0294114 A1 Sep. 26, 2019

(30) Foreign Application Priority Data

Mar. 20, 2018 (EP) ..... 18162851

(51) Int. Cl.
*G04B 19/28* (2006.01)

(52) U.S. Cl.
CPC ..... *G04B 19/283* (2013.01); *G04B 19/286* (2013.01)

(58) Field of Classification Search
CPC ..... G04B 19/283; G04B 19/28; G04B 19/286
See application file for complete search history.

(56) References Cited

U.S. PATENT DOCUMENTS 9,395,694 B1 7/2016 Wong
2013/0329536 A1* 12/2013 Silvant ..... G04B 19/283 368/295
2014/0362670 A1 12/2014 Fleury et al.
2015/0185702 A1 7/2015 Silvant
2015/0198926 A1 7/2015 Girardin et al.
2016/0306326 A1* 10/2016 Born ..... G04B 31/016
(Continued)

FOREIGN PATENT DOCUMENTS

CH 703 400 A1 1/2012
CN 103472709 A 12/2013
CN 104412176 A 3/2015
(Continued)

OTHER PUBLICATIONS

Combined Chinese Office Action and Search Report dated Sep. 18, 2020 in Chinese Application 201910208584.4 (with English Translation), citing documents AO-AR therein, 14 pages.
(Continued)

*Primary Examiner* — Sean Kayes
(74) *Attorney, Agent, or Firm* — Oblon, McClelland, Maier & Neustadt, L.L.P.

(57) ABSTRACT

An annular rotating bezel system to be rotatably mounted on a case middle of a watch case inside which is housed a timepiece movement which extends in a plane, including a rotating bezel, an annular holding ring, a toothed ring, and a spring ring which extends in a plane in which it is capable of deforming elastically along a radius, the spring ring cooperating elastically with the toothed ring, the toothed ring and the spring ring being held in an axial direction perpendicular to the plane of the movement in the bezel by the annular holding ring, either the toothed ring or the spring ring being arranged to be angularly joined to the rotating bezel, and the other being arranged to be angularly joined to the case middle, wherein the spring ring has a thinned portion to increase the flexibility of the spring ring in its plane, the thinned portion having a tooth elastically and radially meshed with the toothed ring.

19 Claims, 3 Drawing Sheets

(56) References Cited

U.S. PATENT DOCUMENTS

| | | | | |
|---|---|---|---|---|
| 2018/0059620 | A1 | 3/2018 | Baebler et al. | |
| 2018/0067457 | A1* | 3/2018 | Cardot | G04B 19/00 |

FOREIGN PATENT DOCUMENTS

| | | | | | |
|---|---|---|---|---|---|
| CN | 104834206 | A | | 8/2015 | |
| DE | 102008029429 | | * | 4/2009 | G04B 17/066 |
| EP | 0 216 420 | A1 | | 4/1987 | |
| EP | 2 672 333 | A1 | | 12/2013 | |
| EP | 3 276 432 | A1 | | 1/2018 | |
| JP | 3-63887 | U | | 6/1991 | |
| JP | 6-186355 | | | 7/1994 | |
| JP | 2015-503738 | A | | 2/2015 | |
| JP | 2015-518967 | A | | 7/2015 | |
| JP | 2015-520390 | A | | 7/2015 | |
| JP | 2018-31774 | A | | 3/2018 | |

OTHER PUBLICATIONS

European Search Report dated Nov. 13, 2018 in European Application 18162851.2, filed on Mar. 20, 2018 (with English Translation of Categories of Cited Documents).

Office Action dated Jul. 15, 2020 in corresponding Korean Patent Application No. 10-2019-0029947 (with English Translation), citing documents AO and AP therein, 12 pages.

Office Action dated Aug. 11, 2020 in corresponding Japanese Patent Application No. 2019-044503 (with Partial English Translation), citing documents AO-AT therein, 6 pages.

* cited by examiner

ANNULAR ROTATING BEZEL SYSTEM COMPRISING A SPRING RING

CROSS-REFERENCE TO RELATED APPLICATION

This application claims priority to European Patent Application No. 18162851.2 filed on Mar. 20, 2018, the entire disclosure of which is hereby incorporated herein by reference.

FIELD OF THE INVENTION

The invention concerns an annular rotating bezel system.

The invention also concerns a watch case comprising a middle part and the annular rotating bezel system rotatably mounted on the case middle.

The invention concerns a watch including the watch case. The watch is, for example, a diver's watch, although this is not limiting in the context of the present invention.

BACKGROUND OF THE INVENTION

Known annular rotating bezel systems comprise a rotating bezel, an annular holding ring, a toothed ring and a spring ring. A rotating bezel system of this type is, for example, described in European Patent No 2672333A1. The spring ring extends in a plane in which it is capable of deforming elastically along a radius and cooperates elastically with the toothed ring. To achieve this, elastic arms intended to cooperate with the toothed ring are arranged on an inner edge of the spring ring, by cutting the latter. The toothed ring and the spring ring are held axially by the rotating bezel and the annular holding ring. The spring ring is angularly joined to the rotating bezel, and the toothed ring is angularly joined to the case middle. However, in a rotating bezel system of this type, the spring ring has limited flexibility in the plane that it defines. This means that sufficient width must be provided in the system to ensure enough clear space radially for deformation of the spring ring, and therefore requires a significant amount of space. Further, the manufacture of such a spring ring is relatively complex, because of the cutting operation to form the elastic arms.

SUMMARY OF THE INVENTION

It is thus an object of the invention to provide an annular rotating bezel system that increases the flexibility of the spring ring in its plane, but which is simple to manufacture, and overcomes the aforementioned drawbacks of the state of the art.

To this end, the invention concerns an annular rotating bezel system, which includes the features mentioned in the independent claim 1.

Specific embodiments of the system are defined in the dependent claims 2 to 12.

A first advantage of the present invention is that it increases the flexibility of the spring ring in its plane. Indeed, owing to the thinned portions contained therein, the spring ring flexes in its plane, allowing the teeth it carries to move in and out of mesh with the toothed ring as the bezel rotates. This makes it possible to reduce the width required for the spring ring to operate in the system and thus to obtain a space saving as regards the width of the assembly.

Further, such an arrangement is simple to manufacture, compact in diameter, and makes it possible to obtain precisely controlled dimensions for the spring ring and the toothed ring. Moreover, such a configuration of the spring ring does not require tongues or strips to be added to the ring, since the spring ring is formed of a single piece of material.

Finally, this arrangement allows a material to be chosen for the toothed ring independently of the material used for the rotating bezel. This makes it possible, for example, to make bezels from precious material with no risk of premature wear since the toothed ring is not integrated in the bezel but is simply secured to said bezel.

Advantageously, the rotating bezel includes at least one lug extending over an inner lateral face of the bezel, and the spring ring has, on an outer edge, at least one hollow in which the bezel lug is engaged. This means the spring ring can easily be rotatably connected to the rotating bezel, while facilitating the positioning of the spring ring in the bezel.

Advantageously, the toothed ring has, on an inner edge, at least one lug intended to be received in a hollow arranged in an external cylindrical surface of the case middle. This allows easy angular joining of the toothed ring to the case middle, while facilitating the positioning of the toothed ring on the case middle and allowing the rotating bezel system to be guided for assembly on the case middle.

According to a first embodiment of the invention, the teeth of the toothed ring and the or each tooth of the spring ring have an asymmetrical shape in the plane defined by the spring ring. In this first embodiment, the spring ring can rotate with respect to the toothed ring in a single predefined direction: clockwise or anticlockwise depending on the shape chosen for the teeth. This first embodiment of the invention thus corresponds to a unidirectional rotating bezel.

According to a second embodiment of the invention, the teeth of the toothed ring and the tooth or each tooth of the spring ring have a symmetrical shape in the plane defined by the spring ring. In this second embodiment, the spring ring can rotate with respect to the toothed ring in one or other of the two directions: clockwise or anticlockwise. This second embodiment of the invention thus corresponds to a two-directional rotating bezel.

Advantageously, the annular rotating bezel system consists of on an independent module, said module being configured to be clipped onto the case middle. This provides a simple, practical means of mounting the rotating bezel system on the case middle, and also allows easy disassembly. This makes it possible to further simplify the method for manufacturing the watch case. The clip mounting system used forms a free hooking system.

To this end, the invention also concerns a watch case including the annular rotating bezel system described above, and which includes the features mentioned in the dependent claim 13.

A particular embodiment of the watch case is defined in the dependent claim 14.

To this end, the invention also concerns a watch including the watch case described above, and which includes the features mentioned in the dependent claim 15.

BRIEF DESCRIPTION OF THE DRAWINGS

The objects, advantages and features of the annular rotating bezel system according to the invention will appear more clearly in the following description, based on at least one non-limiting embodiment illustrated by the drawings, in which.

DETAILED DESCRIPTION OF THE INVENTION

Figure 1:
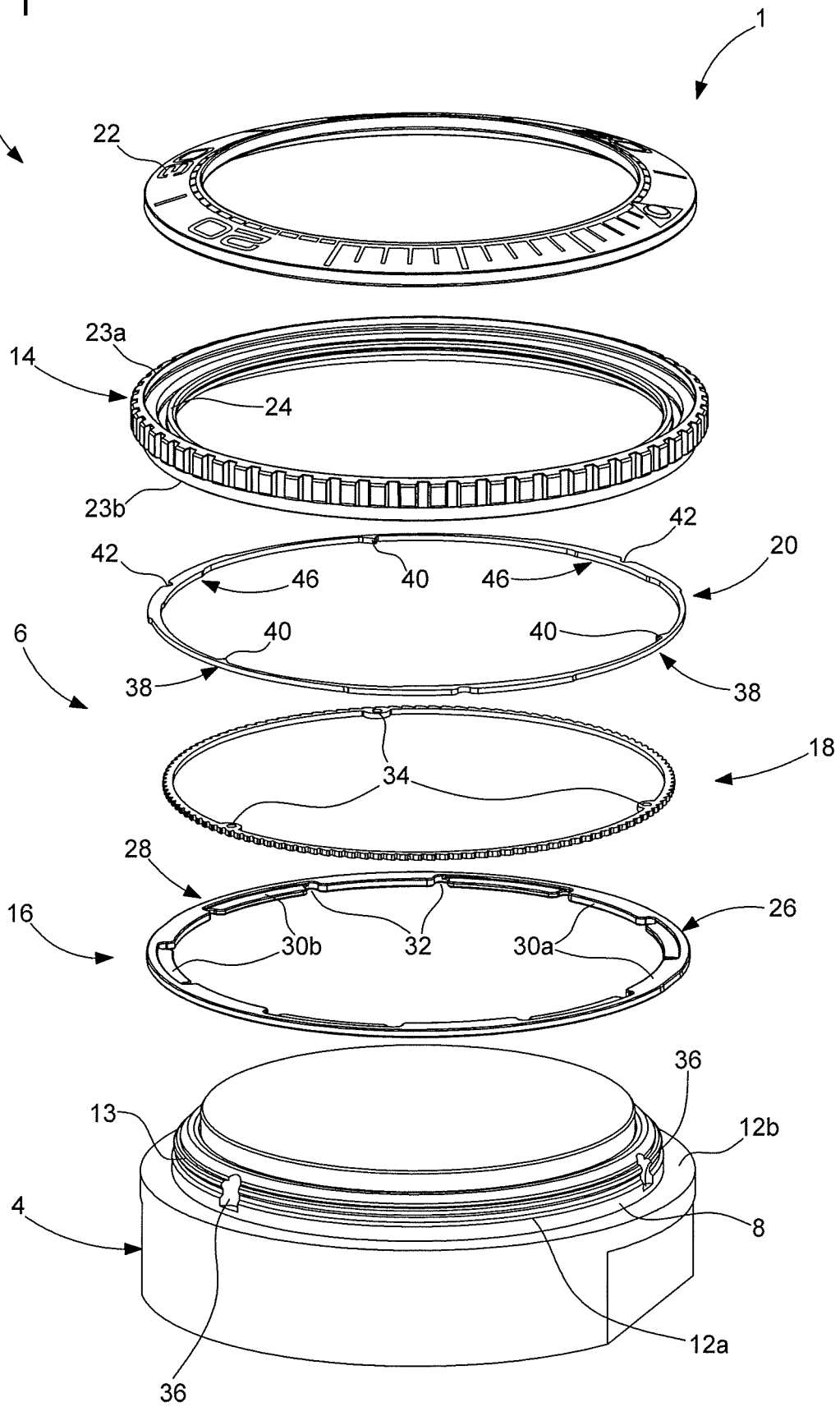
FIG. 1 is an exploded perspective view of the annular rotating bezel system according to the invention.
Figure 2:
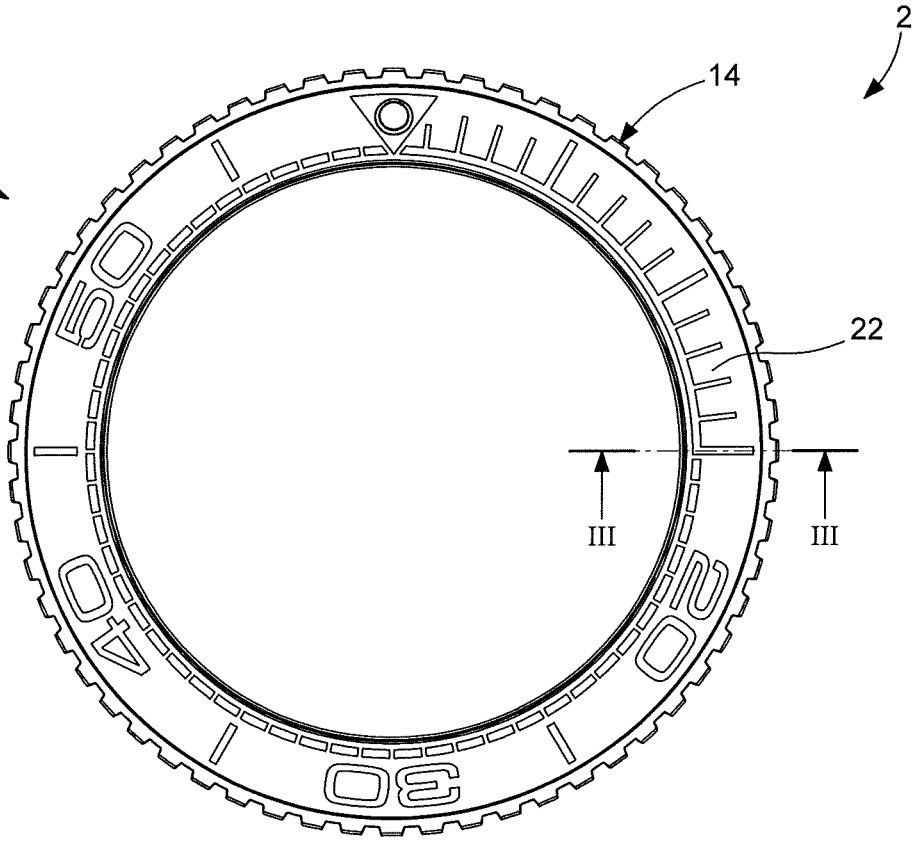
FIG. 2 is a top view of the annular rotating bezel system of FIG. 1, once assembled.

FIG. 1 represents a watch 1 provided with a watch case 2. Watch case 2 typically includes a case middle 4. Watch case 2 also includes an annular rotating bezel system 6 and a timepiece movement that extends in a plane, the timepiece movement being omitted from the Figures for reasons of clarity. The annular rotating bezel system 6 is rotatably mounted on case middle 4. Preferably, as illustrated in FIGS. 1 to 5, annular rotating bezel system 6 consists of an independent module. Annular rotating bezel system 6 is, for example, clipped onto case middle 4, as will be detailed hereinafter.

Figure 3:
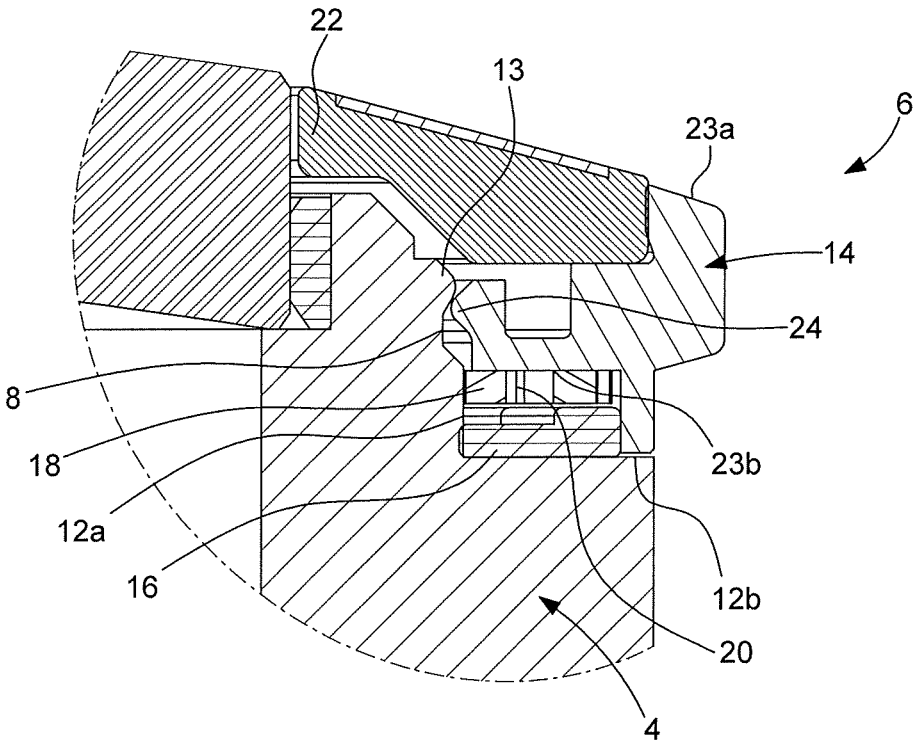
FIG. 3 is a sectional view of the system of FIG. 2, taken along a sectional plane III-III.

As illustrated in FIG. 1, case middle 4 is of annular shape. Case middle 4 includes an external cylindrical surface 8. As seen in FIG. 3, external cylindrical surface 8 is provided with a peripheral shoulder defined by a lateral wall 12*a* and a base 12*b*. This peripheral shoulder serves as a housing for rotating bezel system 6. Lateral wall 12*a* includes an annular protrusion or bulge 13 extending over the entire perimeter of lateral wall 12*a* and allowing rotating bezel system 6 to be secured by clipping onto case middle 4. Annular rotating bezel system 6 rests on base 12*b*. Rotating bezel system 6 is thus mounted on case middle 4, from the top of the latter, thereby blocking system 6 in an axial direction perpendicular to the plane of the timepiece movement, while allowing rotation of the bezel around case middle 4. In the watch case 2 taken as an example in FIGS. 1 to 5, the configuration of the watch case is substantially circular. However, the invention is not limited to this watch case configuration, or to the other arrangements described above for case middle 4. The case middle may be made of metal, typically steel, titanium, gold, platinum or ceramic, typically made from alumina, zirconia or silicon nitride.

Annular rotating bezel system 6 includes a rotating bezel 14, an annular holding ring 16, a toothed ring 18 and a spring ring 20. Preferably, system 6 further includes a decorative ring 22 press fitted onto rotating bezel 14. Decorative ring 22 bears, for example, graduations, typically diving graduations in the case of a diver's watch 1. Decorative ring 22 is for example made of ceramic.

Rotating bezel 14 is of annular shape and includes an upper surface 23*a* visible to the user and a lower surface 23*b*. As illustrated in FIGS. 1 and 3, rotating bezel 14 is, for example, provided with an annular rim 24 on an inner edge. Annular rim 24 engages by clipping together with protrusion 13 of case middle 4, and forms therewith a free hooking system. Rotating bezel 14 is, for example, made of metal but could be made of any other material, for example, of ceramic.

Annular ring 16 holds toothed ring 18 and spring ring 20 in bezel 14, in an axial direction perpendicular to the plane of the timepiece movement. This facilitates the mounting of rotating bezel 14 on case middle 4. Preferably, and as seen in FIG. 3, annular ring 16 is pressed into rotating bezel 14, securing it thereto. In a variant not represented in the Figures, annular ring 16 is secured to case middle 4.

Annular ring 16 rests on base 12*b* of case middle 4, and thus surrounds external cylindrical surface 8 of case middle 4. Annular ring 16 is configured to cooperate with external cylindrical surface 8 to allow rotation of rotating bezel 14 on case middle 4. Annular holding ring 16 is, for example, a flat ring.

According to a particular variant illustrated in FIG. 1, annular ring 16 includes means 26 for guiding rotating bezel 14 in rotation around case middle 4 and means 28 configured to brake the rotation of rotating bezel 14 around case middle 4 and to dampen sound. In this variant illustrated in FIG. 1, annular ring 16 is, for example, formed of a single piece of material consisting of a plastic material, especially PTFE, ethylene tetrafluoroethylene (Tefzel®), and polyoxymethylene (Delrin®), where necessary coated with a layer intended to improve the friction coefficient. Annular ring 16 is, for example, of generally rectangular cross-section.

Preferably, as represented in FIG. 1, annular ring 16 includes, on an inner edge, an alternation of tongues 30*a* of a first group of tongues, and tongues 30*b* of a second group of tongues. Tongues 30*a* of the first group and tongues 30*b* of the second group are in contact with external cylindrical surface 8 of case middle 4. Such tongues 30*a*, 30*b* limit the passage of dirt into rotating bezel system 6. In the variant not represented in the Figures, wherein annular ring 16 is integral with case middle 4, tongues 30*a* of the first group and tongues 30*b* of the second group are arranged on an external edge of annular ring 16 and are in contact with an inner surface of rotating bezel 14.

In the example embodiment of FIG. 1, the first and second groups of tongues each include six tongues 30*a*, 30*b*, distributed over the inner edge of ring 16 over 360°. The tongues of the same group of tongues are thus spaced apart from each other by 60°, tongues 30*a*, 30*b* of the first and second groups of tongues being alternated.

Tongues 30*a* of the first group and tongues 30*b* of the second group have different dimensions in the radial direction. In the example embodiment of FIG. 1, tongues 30*a* of the first group of tongues have smaller dimensions in the radial direction than those of tongues 30*b* of the second group of tongues, and form rotational guiding means 26.

Tongues 30*b* of the second group of tongues form braking and sound dampening means 28. More precisely, tongues 30*b* of the second group of tongues are formed of more flexible segments than tongues 30*a* of the first group. These segments are able to bend in an axial direction perpendicular to the plane of the timepiece movement. To achieve this, a specific example embodiment represented in FIG. 1 consists in that tongues 30*a* of the first group and tongues 30*b* of the second group have different thicknesses, the thickness being measured in the axial direction perpendicular to the plane of the timepiece movement. Typically, tongues 30*b* of the second group have a smaller thickness than that of tongues 30*a* of the first group, thereby giving them greater flexibility. Due to the axial flexibility of tongues 30*b* of the second group, said tongues can brake the rotation of rotating bezel 14 about case middle 4 by friction against external cylindrical surface 8, and also dampen the sound produced.

Braking the rotation of bezel 14 via means 28 has the advantage of smoothing the different plays inside the system so that the user of the bezel does not feel them, and of controlling the rotational torque of the bezel by softening it. Further, braking and sound dampening means 28 reduce the noise produced by rotation of the bezel and thus improve user experience.

Preferably, tongues 30*a*, 30*b* of the first and second groups are separated from each other by hollows 32. This improves, in particular, the flexibility of tongues 30*b* of the second group of tongues.

Preferably too, as seen in FIG. 1, tongues 30*a*, 30*b* of the first and second groups of tongues extend angularly over a substantially equal angular sector.

Evidently, in other variants of the invention, the annular holding ring may comprise a single annular ring of rectangular cross-section over its entire circumference pressed into bezel 14.

Toothed ring 18 includes several teeth, for example 120 teeth, also distributed over 360° on its external edge. Preferably, toothed ring 18 also has, on its inner edge, at least one lug 34 received in a hollow 36 provided in external cylindrical surface 8 of case middle 4. In the example embodiments illustrated in FIGS. 1 to 5, toothed ring 18 includes three lugs 34 distributed over 360° and spaced apart from each other by 120°. External cylindrical surface 8 of case middle 4 has three corresponding hollows 36. This system of lugs 34/hollows 36 allows easy angular joining of toothed ring 18 to case middle 4, while facilitating the positioning of toothed ring 18 on case middle 4. This system also allows rotating bezel system 6 to be guided for mounting on case middle 4. Thus, pressing from the top of system 6 causes lugs 34 to engage in hollows 36, locking the elements inside system 6 and clipping system 6 onto case middle 4.

Toothed ring 18 is formed of a single piece of material. Toothed ring 18 is formed, for example, of a metal alloy, especially a cobalt based alloy (40% Co, 20% Cr, 16% Ni and 7% Mo) commercially known as phynox or steel, typically a stainless steel such as 316L steel. In a variant, toothed ring 18 may be formed of a thermoplastic material, particularly a thermostable, semi-crystalline thermoplastic material, such as, for example polyarylamide (Ixef®), polyetheretherketone (PEEK) or made of a ceramic material such as zirconia or alumina.

Figure 4:
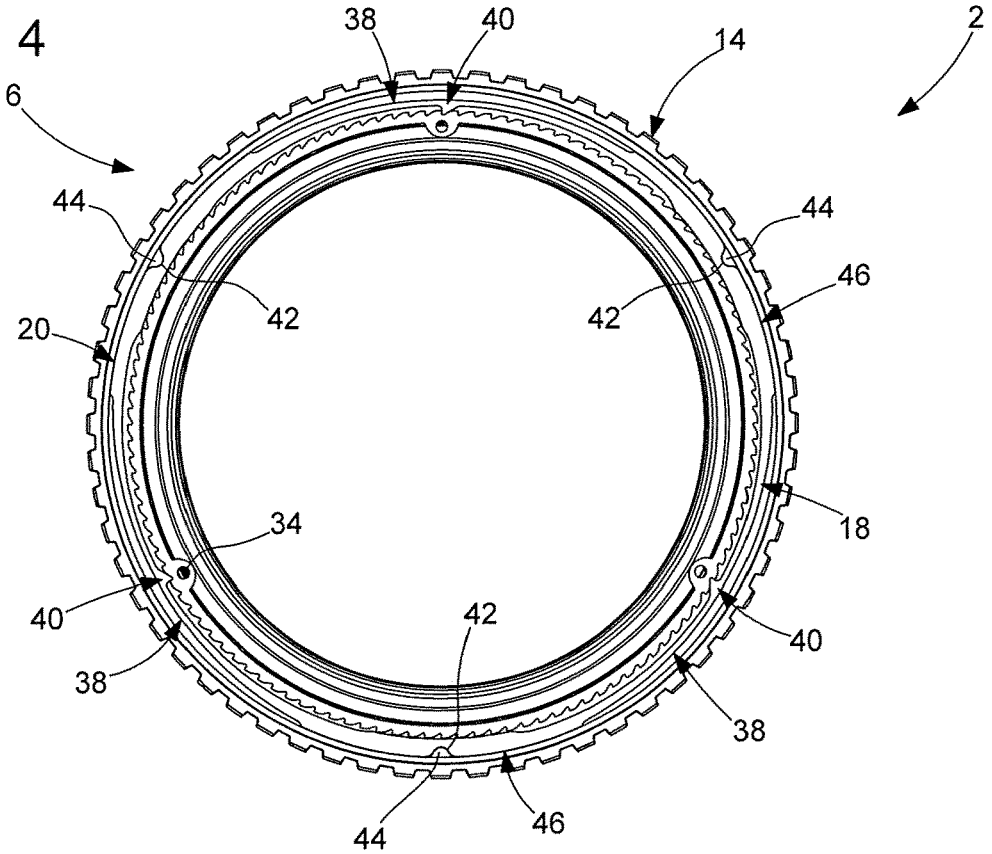
FIG. 4 is a bottom view of the annular rotating bezel system of FIG. 1, according to a first embodiment of the invention.
Figure 5:
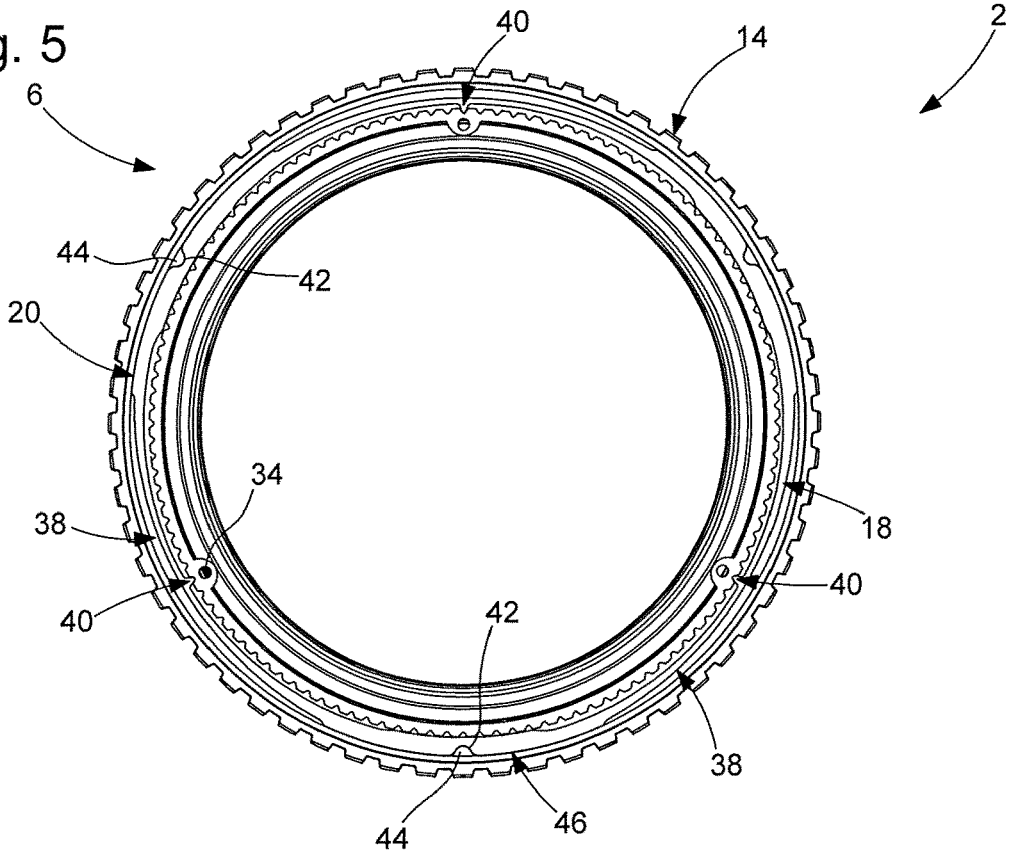
FIG. 5 is a bottom view of the annular rotating bezel system of FIG. 1, according to a second embodiment of the invention.

As visible in FIGS. 4 and 5, toothed ring 18 is arranged to be inserted into spring ring 20, i.e. toothed ring 18 is sized to be able to be placed inside spring ring 20. Toothed ring 18 and spring ring 20 are concentric and coplanar and are held between lower face 23*b* of bezel 14 and an upper face of holding ring 16.

Spring ring 20 engages elastically with toothed ring 18. More specifically, spring ring 20 comprises at least one thinned portion 38 having at least one tooth 40 elastically and radially in mesh with toothed ring 18. In the example embodiments illustrated in FIGS. 1 to 5, spring ring 20 comprises three thinned portions 38 distributed over 360°, each thinned portion 38 having one tooth 40 arranged in a median part of thinned portion 38. The three thinned portions 38 are spaced apart by 120° from each other. Spring ring 20 extends in a plane in which it is capable of deforming elastically along one radius. Thinned portions 38 are arranged to increase the flexibility of spring ring 20 in its plane. This configuration means that, when toothed ring 18 is inserted inside spring ring 20, teeth 40 cooperate with the teeth of toothed ring 18. In this configuration, each tooth 40 is in contact with the toothed ring so that there is a rest position in which each tooth 40 is in a hollow between two teeth of toothed ring 18. When the user takes hold of bezel 14 and rotates it, the flexibility of spring ring 2' provided by thinned portions 38, causes spring ring 20 to deform elastically in its plane, allowing teeth 40 to be released from the hollows of toothed ring 18 and to re-engage in an adjacent tooth of toothed ring 18. Bezel 14 then actually rotates by a corresponding angular sector into a new position.

Preferably, as illustrated in FIGS. 1, 4 and 5, thinned portions 38 are thinned radially.

Again preferably, spring ring 20 has on its outer edge at least one hollow 42 in which a lug 44 of bezel 14 is engaged to join these two elements in rotation. In the example embodiments illustrated in FIGS. 1 to 5, toothed ring 20 includes three hollows 42 distributed over 360° and spaced apart from each other by 120° and rotating bezel 14 has three corresponding lugs 44 on an inner lateral face. Hollows 42 are arranged in portions 46 of spring ring 20 that are thicker than thinned portions 38 in median parts of these portions 46. Thus, teeth 40 and hollows 42 are alternated on spring ring 20, regularly distributed over 360°. This system of lugs 44/hollows 42 makes it easy to rotatably connect spring ring 20 to rotating bezel 14, while facilitating the positioning of spring ring 20 in bezel 14.

Spring ring 20 is formed of a single piece of material. Spring ring 20 is, for example, formed of a metal alloy having good spring properties, i.e. which deforms elastically easily while being able to deform significantly without undergoing Plastic deformation, especially Phynox® or amorphous metal alloys. Of course, spring ring 20 can also, in a variant, be made from a synthetic material.

A first embodiment of the invention will now be described with reference to FIG. 4. According to this first embodiment, the teeth of toothed ring 18 and teeth 40 of spring ring 20 have an asymmetrical shape in the plane defined by spring ring 20. The asymmetrical shape is, for example, a 'wolf tooth' shape, i.e. the teeth are substantially right triangle-shaped. In the meshed position of the teeth, the hypotenuse of the triangle formed by each tooth 40 of the spring ring extends along the hypotenuse of the triangle formed by one of the teeth of toothed ring 18.

Teeth 40, each arranged in a median part of a thinned portion 38, are regularly distributed over 360°. Thus, in the example illustrated in FIG. 4, in which spring ring 20 has three teeth 40, teeth 40 are spaced apart by 120° from each other.

In this first embodiment, spring ring 20 can rotate relative to toothed ring 18 in a single predefined direction: clockwise or anticlockwise depending on the shape chosen for the teeth. This first embodiment of the invention thus corresponds to a unidirectional rotating bezel 14.

A second embodiment of the invention will now be described with reference to FIG. 5. According to this second embodiment, the teeth of toothed ring 18 and teeth 40 of spring ring 20 have a symmetrical shape in the plane defined by spring ring 20. The symmetrical shape is, for example, an isosceles triangle or equilateral triangle.

In this second embodiment, spring ring 20 can rotate relative to toothed ring 18 in one or other of the two directions: clockwise or anticlockwise. This second embodiment of the invention thus corresponds to a two-directional rotating bezel 14.

Preferably, according to this second embodiment, spring ring 20 includes three thinned portions 38 regularly distributed over 360°. Each thinned portion 38 carries one tooth 40.

The preceding description of the annular rotating bezel system was given with reference to a toothed ring angularly joined to the case middle, and a spring ring angularly joined to the rotating bezel. However, those skilled in the art will understand that the reverse configuration is possible without departing from the scope of the present invention, i.e. the toothed ring may be angularly joined to the rotating bezel, and the spring ring angularly joined to the case middle.

The invention claimed is:

1. An annular rotating bezel system intended to be rotatably mounted on a case middle of a watch case inside which is housed a timepiece movement which extends in a plane, comprising:

a rotating bezel;

an annular holding ring;

a toothed ring; and a spring ring which extends in a plane and is configured to deform elastically along a radius, the spring ring cooperating elastically with the toothed ring, wherein said toothed ring and said spring ring are held in an axial direction perpendicular to the plane of the movement in the bezel by the annular holding ring, wherein either the toothed ring or the spring ring is arranged to be angularly joined to the rotating bezel, and the other being arranged to be angularly joined to the case middle, and wherein the spring ring has at least one thinned portion arranged to increase the flexibility of the spring ring in its plane, wherein the thinned portion includes at least one tooth extending in a radial direction towards an axis of the spring ring and elastically and radially meshed with the toothed ring, and wherein said tooth is arranged in a median part of the thinned portion.

2. The annular rotating bezel system according to claim 1, wherein said thinned portion is radially thinned.

3. The annular rotating bezel system according to claim 1, wherein the rotating bezel comprises at least one lug extending over an inner lateral surface of the bezel, and wherein the spring ring has, on an outer edge, at least one hollow wherein the lug of the bezel is engaged to allow a rotating connection between the spring ring and the rotating bezel.

4. The annular rotating bezel system according to claim 1, wherein the toothed ring has, on an inner edge, at least one lug intended to be received in a hollow provided in an external cylindrical surface of the case middle, to allow angular joining of the toothed ring to the case middle.

5. The annular rotating bezel system according to claim 1, wherein the spring ring is formed of a single piece of material consisting of a crystalline or amorphous metal alloy.

6. The annular rotating bezel system according to claim 1, wherein the toothed ring is fomred of a single piece of material consisting of a metal alloy.

7. The annular rotating bezel system according to claim 6, wherein the metal alloy is phynox or steel.

8. The annular rotating bezel system according to claim 1, wherein the toothed ring is formed of a single piece of material consisting of a thermostable semi-crystalline thermoplastic material or a ceramic material.

9. The annular rotating bezel system according to claim 8, wherein the thermostable semi-crystalline thermoplastic material is polyarylamide, and wherein the ceramic material is made from zirconia or alumina.

10. The annular rotating bezel system according to claim 8, wherein the thermostable semi-crystalline thermoplastic material is thermostable polyetheretherketone.

11. The annular rotating bezel system according to claim 1, wherein the spring ring comprises three thinned portions distributed over 360°, the three thinned portions being spaced apart from each other by 120°.

12. The annular rotating bezel system according to claim 1, wherein the teeth of the toothed ring and each tooth of the spring ring have an asymmetrical shape in the plane defined by spring ring.

13. The annular rotating bezel system according to claim 1, wherein the teeth of the toothed ring and each tooth of the spring ring have a symmetrical shape in the plane defined by the spring ring.

14. The annular rotating bezel system according to claim 1, wherein said system is formed of an independent module, said module being configured to be clipped onto the case middle.

15. A watch case comprising:

a case middle; and a system provided with an annular rotating bezel rotatably mounted on the case middle, wherein the annular rotating bezel system includes a rotating bezel, an annular holding ring, a toothed ring, and a spring ring which extends in a plane and in configured to deform elastically along a radius, the spring ring cooperating elastically with the toothed ring, wherein said toothed ring and said spring ring are held in an axial direction perpendicular to the plane of the movement in the bezel by the annular holding ring, wherein either the toothed ring or the spring ring is arranged to be angularly joined to the rotating bezel, and the other being arranged to be angularly joined to the case middle, and wherein the spring ring has at least one thinned portion arranged to increase the flexibility of the spring ring in its plane, and wherein the thinned portion has at least one tooth extending in a radial direction towards an axis of the spring ring and elastically and radially meshed with the toothed ring, and wherein said tooth is arranged in a median part of the thinned portion.

16. The watch case according to claim 15, wherein the case middle comprises an external cylindrical surface provided with a peripheral shoulder, the peripheral shoulder comprising, on a lateral face, an annular protrusion, and wherein the rotating bezel is provided on an inner edge with an annular rim, said annular rim cooperating by clipping together with said annular protrusion and forming a free hooking system.

17. A watch comprising a watch case, wherein the watch case conforms to claim 15.

18. An annular rotating bezel system intended to be rotatably mounted on a case middle of a watch case inside which is housed a timepiece movement which extends in a plane, comprising:

a rotating bezel;

an annular holding ring;

a toothed ring; and a spring ring which extends in a plane and is configured to deform elastically along a radius, the spring ring cooperating elastically with the toothed ring, wherein said toothed ring and said spring ring are held in an axial direction perpendicular to the plane of the movement in the bezel by the annular holding ring, wherein either the toothed ring or the spring ring is arranged to be angularly joined to the rotating bezel, and the other being arranged to be angularly joined to the case middle, wherein the spring ring has at least one thinned portion arranged to increase the flexibility of the spring ring in its plane, and wherein the rotating bezel comprises at least one lug extending over an inner lateral surface of the bezel, and wherein the spring ring has, on an outer edge, at least one hollow wherein the lug of the bezel is engaged to allow a rotating connection between the spring ring and the rotating bezel.

19. The annular rotating bezel system according to claim 18, wherein the toothed ring has, on an inner edge, at least one lug intended to be received in a hollow provided in an external cylindrical surface of the case middle, to allow angular joining of the toothed ring to the case middle.

* * * * *